US011782375B2

(12) United States Patent
Matayoshi et al.

(10) Patent No.: US 11,782,375 B2
(45) Date of Patent: Oct. 10, 2023

(54) IMAGE FORMING APPARATUS WITH FIXING UNIT POWERED BY REDUCED HARMONIC SWITCHING

(71) Applicant: CANON KABUSHIKI KAISHA, Tokyo (JP)

(72) Inventors: Yasumasa Matayoshi, Shizuoka (JP); Yuji Fujiwara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/375,592

(22) Filed: Jul. 14, 2021

(65) Prior Publication Data

US 2022/0043387 A1 Feb. 10, 2022

(30) Foreign Application Priority Data

Aug. 5, 2020 (JP) ..... 2020-133163

(51) Int. Cl.
*G03G 15/00* (2006.01)

(52) U.S. Cl.
CPC ..... *G03G 15/80* (2013.01)

(58) Field of Classification Search
USPC ..... 399/88
See application file for complete search history.

(56) References Cited

U.S. PATENT DOCUMENTS

| | | | | |
|---|---|---|---|---|
| 8,606,136 | B2 | 12/2013 | Shimura et al. | 399/67 |
| 9,031,440 | B2 | 5/2015 | Fujiwara | 399/69 |
| 9,342,010 | B2 | 5/2016 | Shimura et al. | G03G 15/2053 |
| 9,429,889 | B2 | 8/2016 | Fujiwara et al. | G03G 15/2064 |
| 9,715,200 | B2 | 7/2017 | Shimura et al. | G03G 15/206 |
| 10,101,695 | B2 | 10/2018 | Shimura et al. | G03G 15/2053 |
| 10,133,218 | B2 | 11/2018 | Masuda et al. | G03G 15/2039 |
| 10,416,595 | B2 | 9/2019 | Ogura et al. | G03G 15/2042 |
| 10,845,741 | B2 | 11/2020 | Fujiwara et al. | G03G 15/80 |
| 2011/0217062 | A1* | 9/2011 | Chosokabe | G03G 15/2039 399/88 |
| 2021/0041817 | A1 | 2/2021 | Fujiwara et al. | G03G 15/2039 |

FOREIGN PATENT DOCUMENTS

| | | |
|---|---|---|
| JP | H09-319441 | 12/1997 |
| JP | H11-167329 | 6/1999 |
| JP | 2013-061900 | 4/2013 |
| JP | 2018-073048 | 5/2018 |

* cited by examiner

*Primary Examiner* — Quana Grainger
(74) *Attorney, Agent, or Firm* — Venable LLP

(57) ABSTRACT

An image forming apparatus includes a fixing unit, a switching element, and a controller. The controller controls the switching element on a half-cycle basis of an alternating current. A period in which the electric power is supplied to the heater within a period of a half-cycle of the alternating current is divided into at least one first power supply period and a second power supply period longer than one first power supply period. A length of a sum of the at least one first power supply period is a length from 1/6000 to 1/40 of one cycle of the alternating current. A sum of electric power supplied in the at least one first power supply period and electric power supplied in the second power supply period is determined depending on a difference between a temperature and a target temperature of the fixing unit.

16 Claims, 11 Drawing Sheets

IMAGE FORMING APPARATUS WITH FIXING UNIT POWERED BY REDUCED HARMONIC SWITCHING

FIELD OF THE INVENTION AND RELATED ART

The present invention relates to an image forming apparatus, particularly relates to the image forming apparatus including an image heating apparatus as an image fixing portion.

The image heating apparatus of the image forming apparatus fixes an unfixed image (toner image) formed on transfer paper by an image forming portion using an electrophotographic process or the like, and as a type thereof, a film heating type in which a heater represented by, for example, a ceramic heater is used as a heat source has been known. In general, the heater is connected to an AC power source through a switching element such as a bidirectional thyristor (hereinafter, referred to as a triac), so that power (electric power) is supplied by this AC power source. When the power is supplied to a high-output heater and temperature control the heater is carried out, phase control is carried out in many cases in order to realize quick responsiveness of the control. On the other hand, in the case where the high-output heater, i.e., the heater low in resistor value is subjected to the phase control, a harmonic current becomes large. As a countermeasure against this problem, a method in which an abrupt current change per unit time is made moderate is considered, and has been proposed, for example, in Japanese Laid-Open Patent Application 2018-073048.

However, as in the conventional method, when the abrupt current change is made moderate, there is a liability that the switching element generates heat.

SUMMARY OF THE INVENTION

The present invention has been accomplished in the above-described circumstances, and a principal object of the present invention is to reduce a harmonic current while suppressing the influence on a switching element.

According to an aspect of the present invention, there is provided an image forming apparatus for forming a toner image on the recording material, comprising: a fixing unit configured to heat and fix the toner image on the recording material, the fixing unit including a heater; a switching element configured to switch between a conduction state in which electric power from an AC power source is supplied to the heater and a non-conduction state in which supply of the electric power to the heater is cut off; and a controller configured to control the switching element so as to maintain a temperature of the fixing unit at a target temperature, the controller controlling the switching element on a half-cycle basis of an alternating current so that electric power determined depending on a difference between the temperature of the fixing unit and the target temperature is supplied to the heater, wherein a period in which the electric power is supplied to the heater within a period of a half-cycle of the alternating current is divided into at least one first power supply period and a second power supply period longer than one first power supply period, wherein a length of a sum of the at least one first power supply period is a length from $1/6000$ to $1/40$ of one cycle of the alternating current, and wherein a sum of electric power supplied in the at least one first power supply period and electric power supplied in the second power supply period is determined depending on the difference between the temperature of the fixing unit and the target temperature.

Further features of the present invention will become apparent from the following description of exemplary embodiments with reference to the attached drawings.

Figure 4:
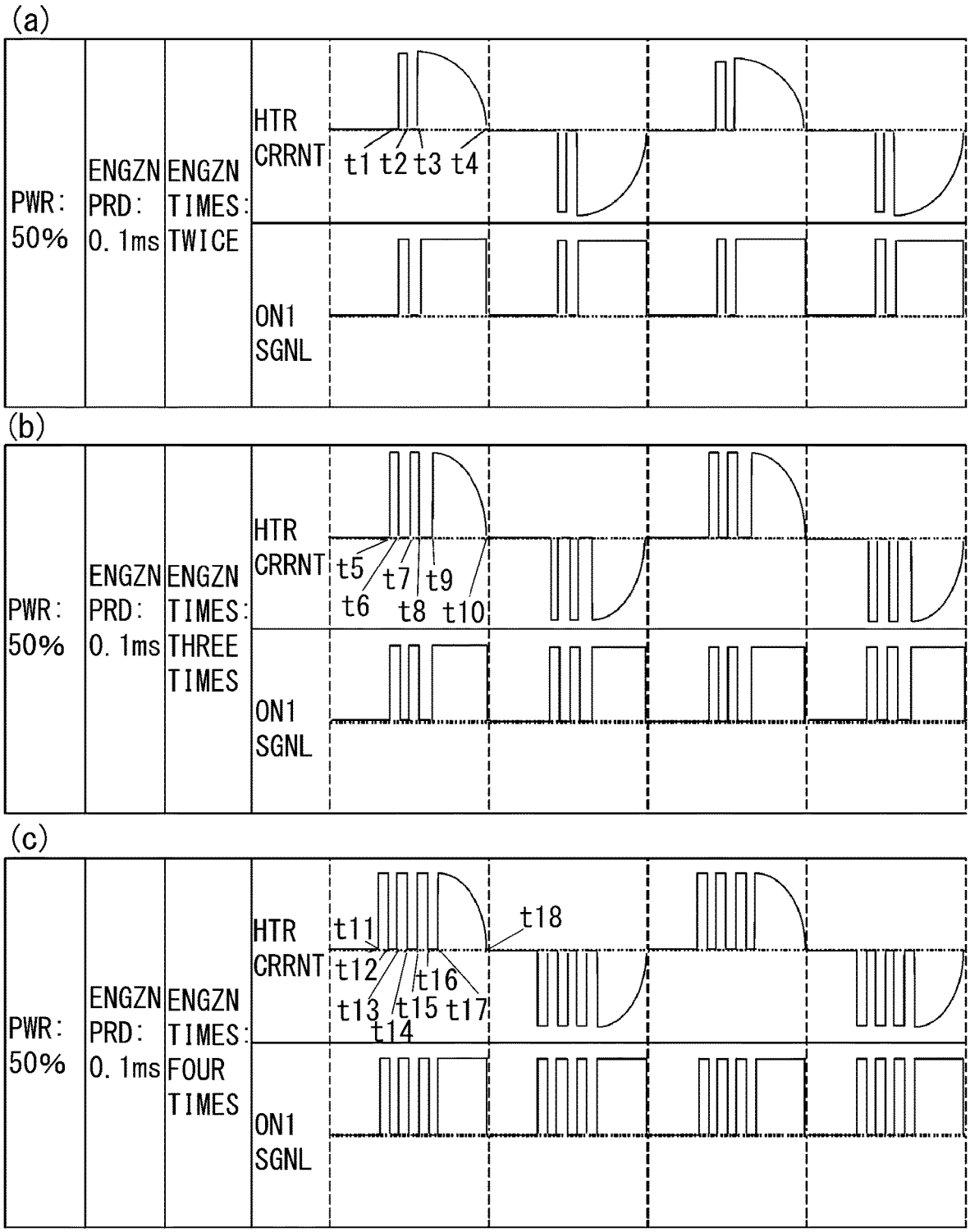

Parts (a) to (c) of FIG. 4 are schematic views each showing a heater current waveform and a control signal in the embodiment 1.

Figure 5:
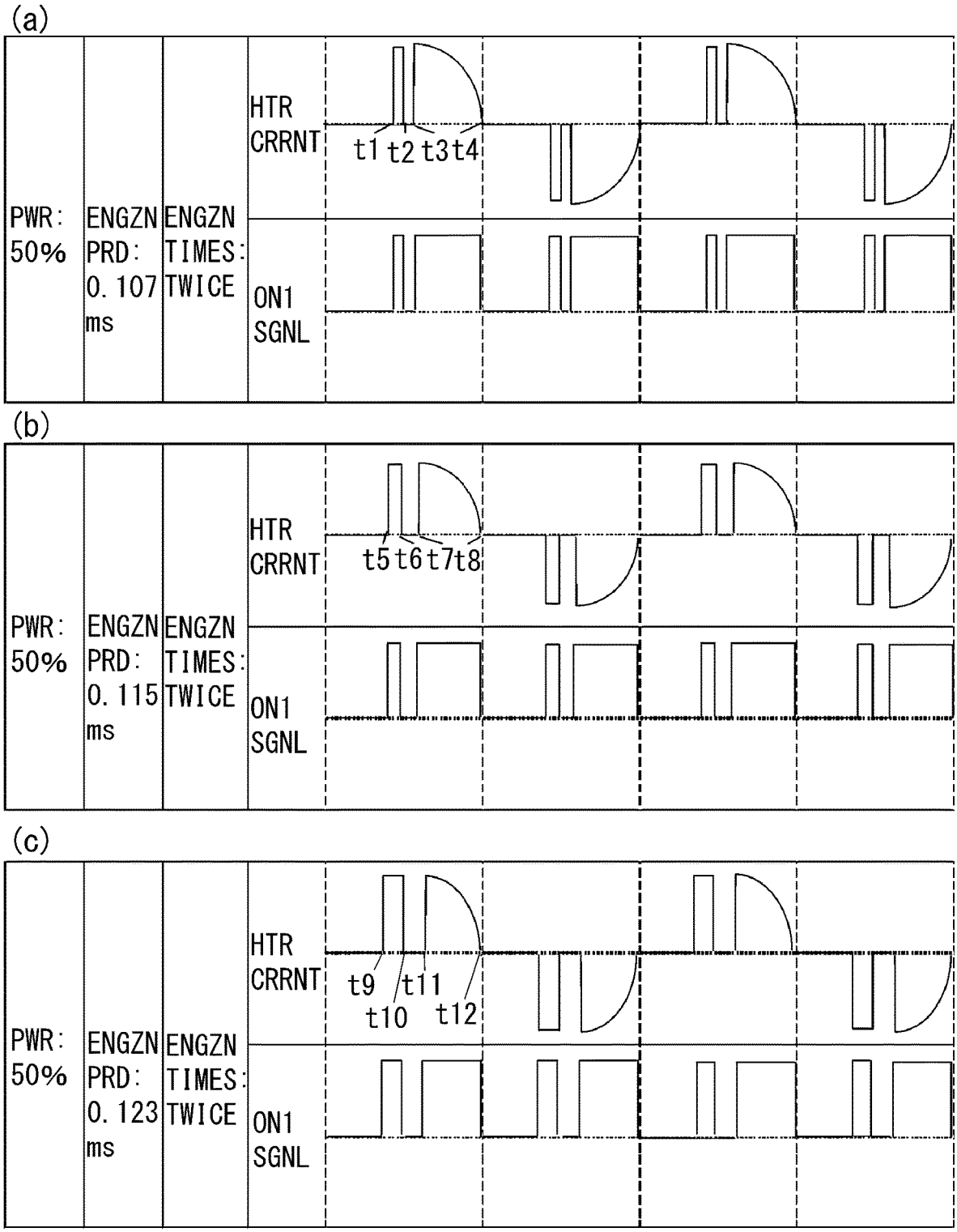

Parts (a) to (c) of FIG. 5 are schematic views each showing a heater current waveform and a control signal in the embodiment 1.

Figure 6:
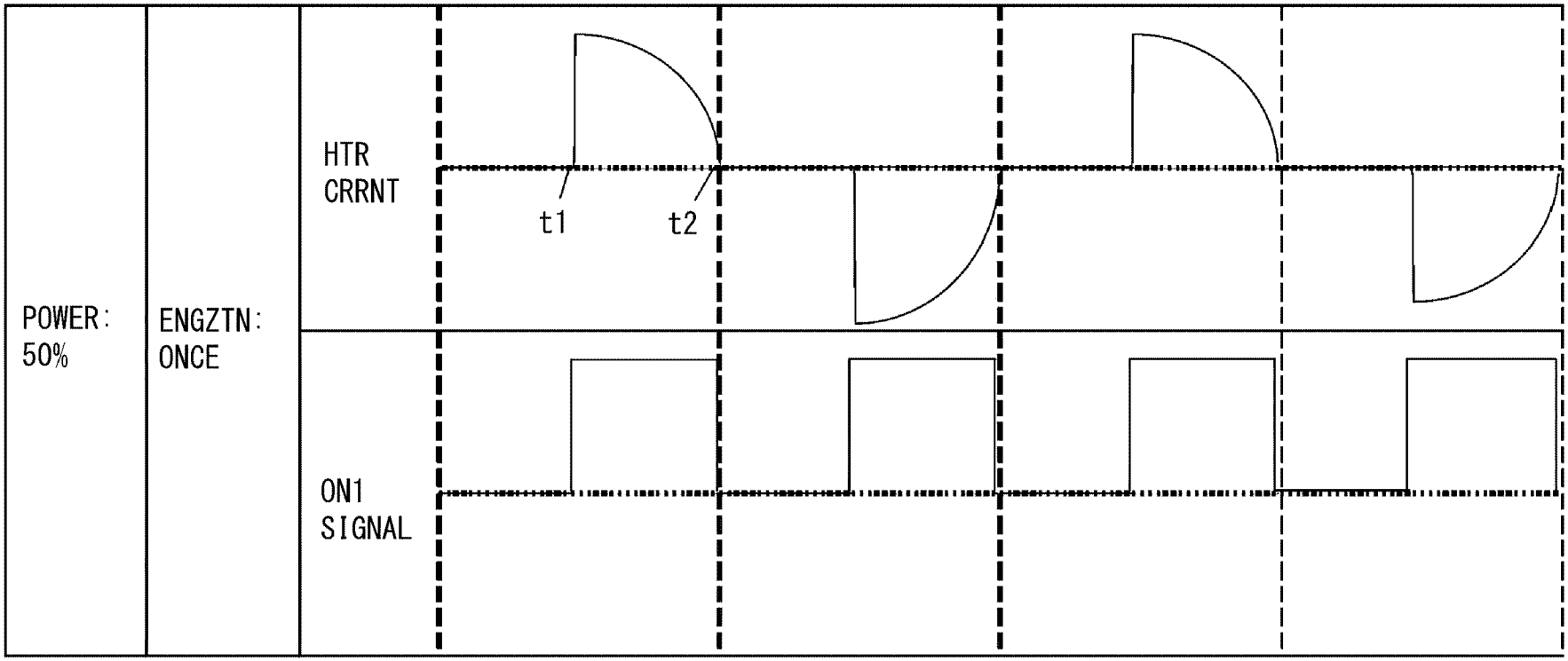

FIG. 6 is a schematic view showing a heater current waveform and a control signal in the case where the embodiment 1 is not carried out.

Figure 7:
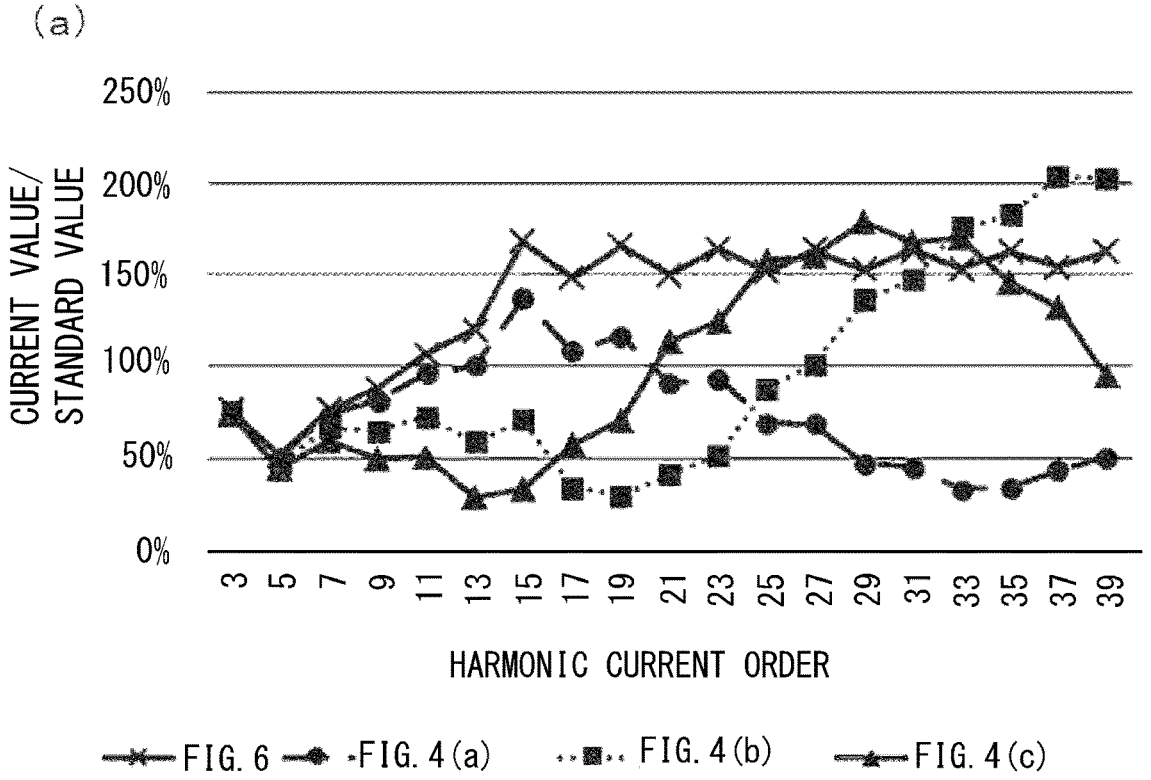
Figure 7:
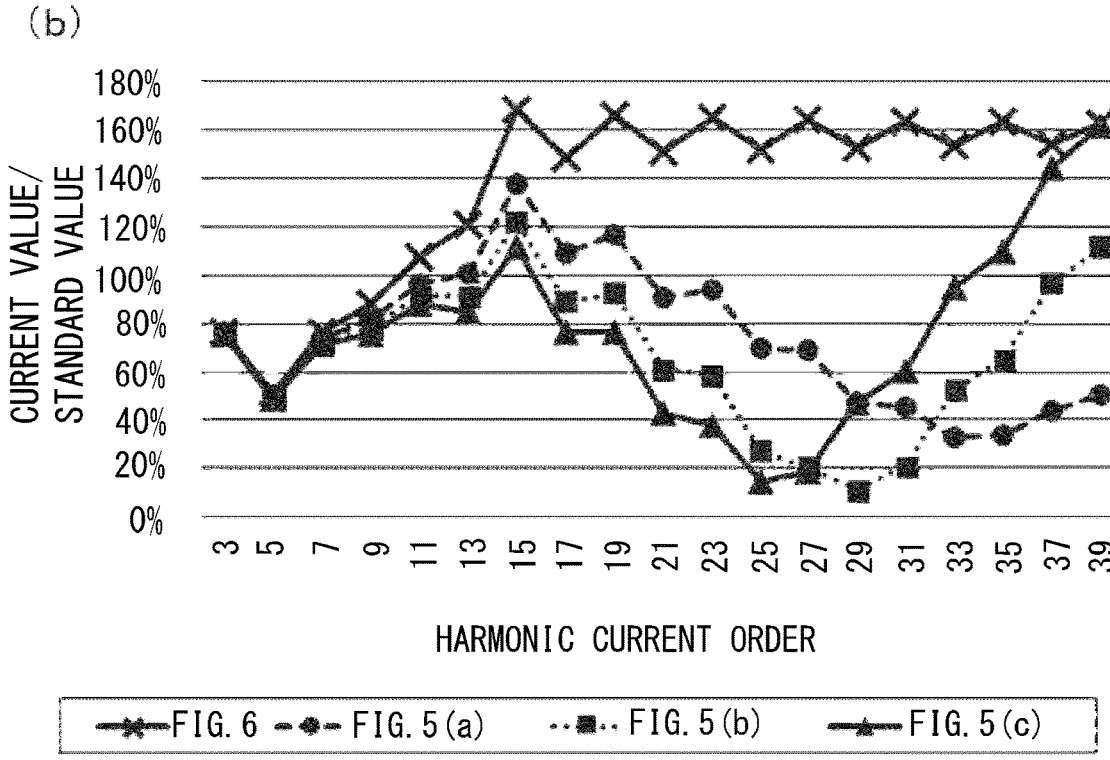

Parts (a) and (b) of FIG. 7 are graphs each showing a measurement result of a harmonic current in the embodiment 1.

Figure 8:
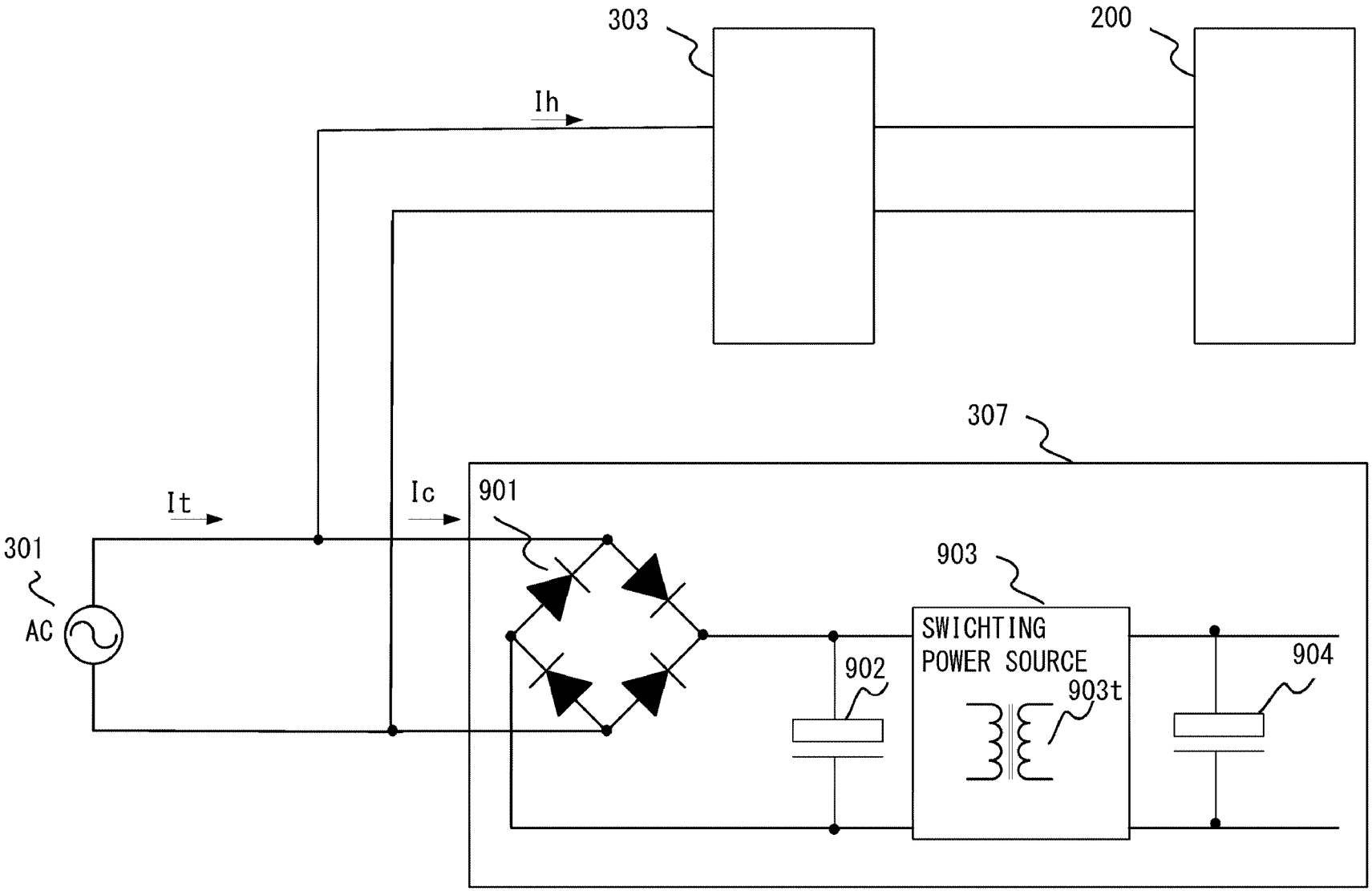

FIG. 8 is a schematic view of a power source device in the embodiment 2.

Figure 9:
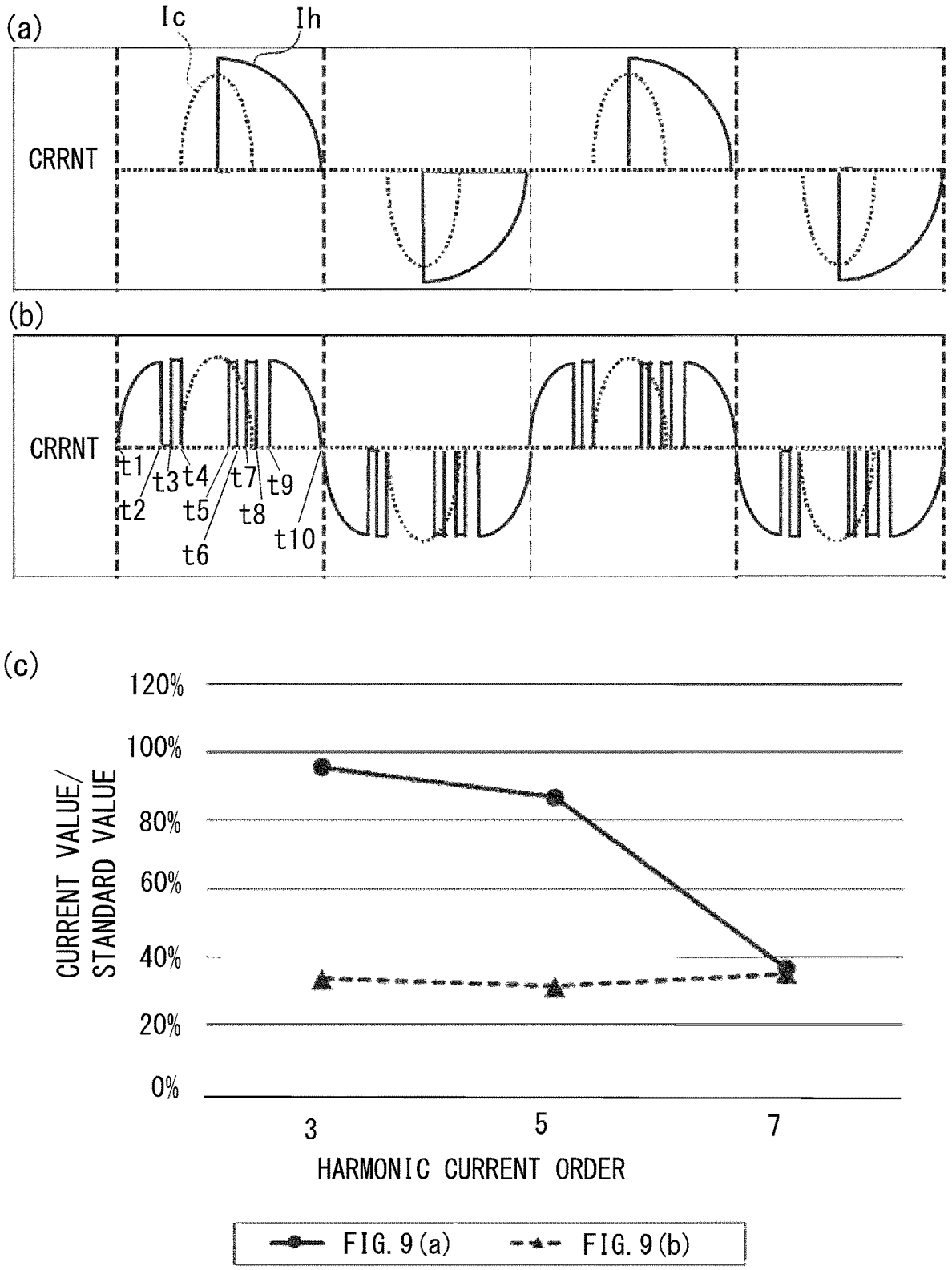

Parts (a) and (b) of FIG. 9 are schematic views each showing a heater current waveform and a connect signal in the embodiment 2, and part (c) of FIG. 9 is a graph showing a measurement result of a harmonic current in the embodiment 2.

Figure 10:
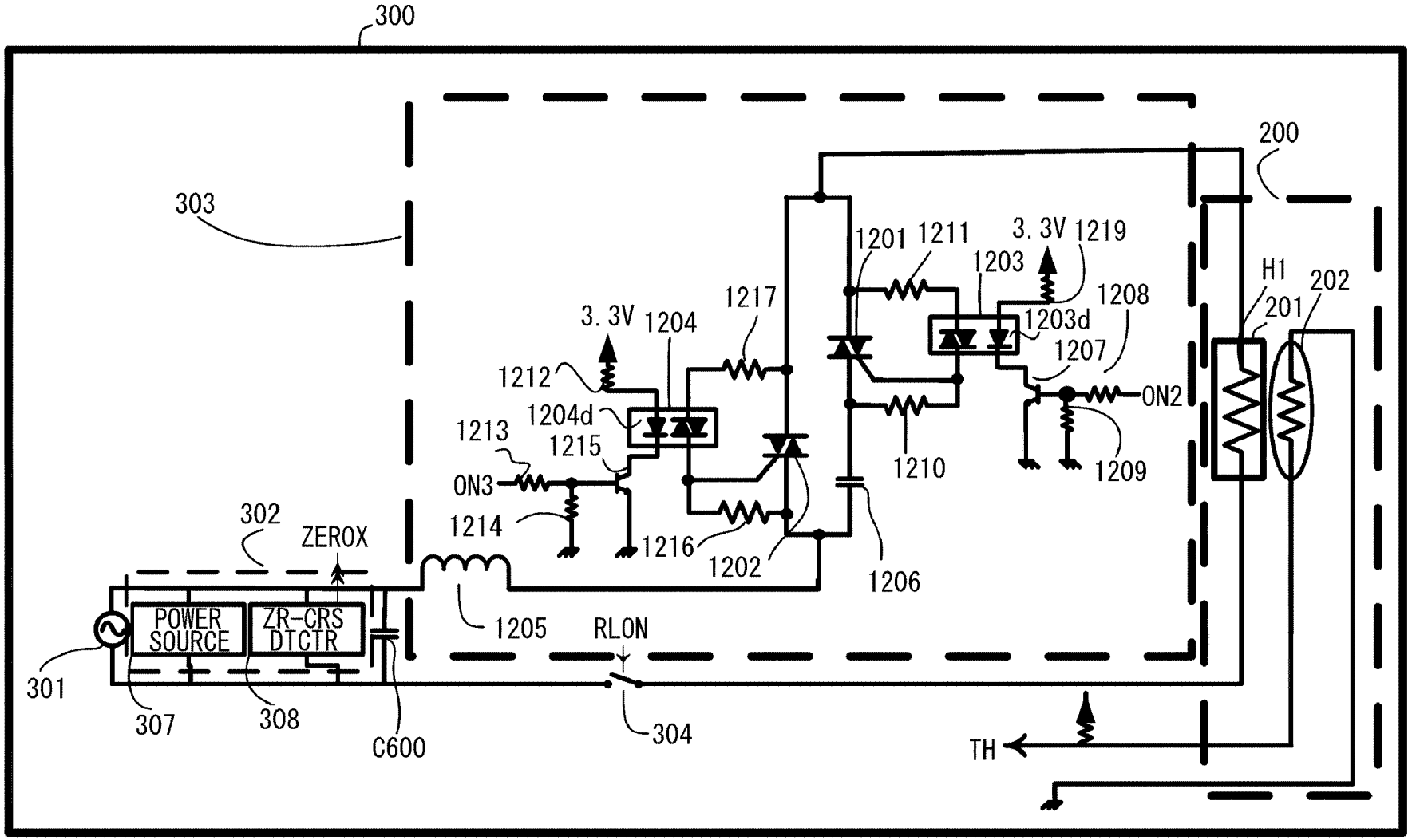

FIG. 10 is a schematic view of a heater control circuit using a triac in the embodiment 3.

Figure 11:
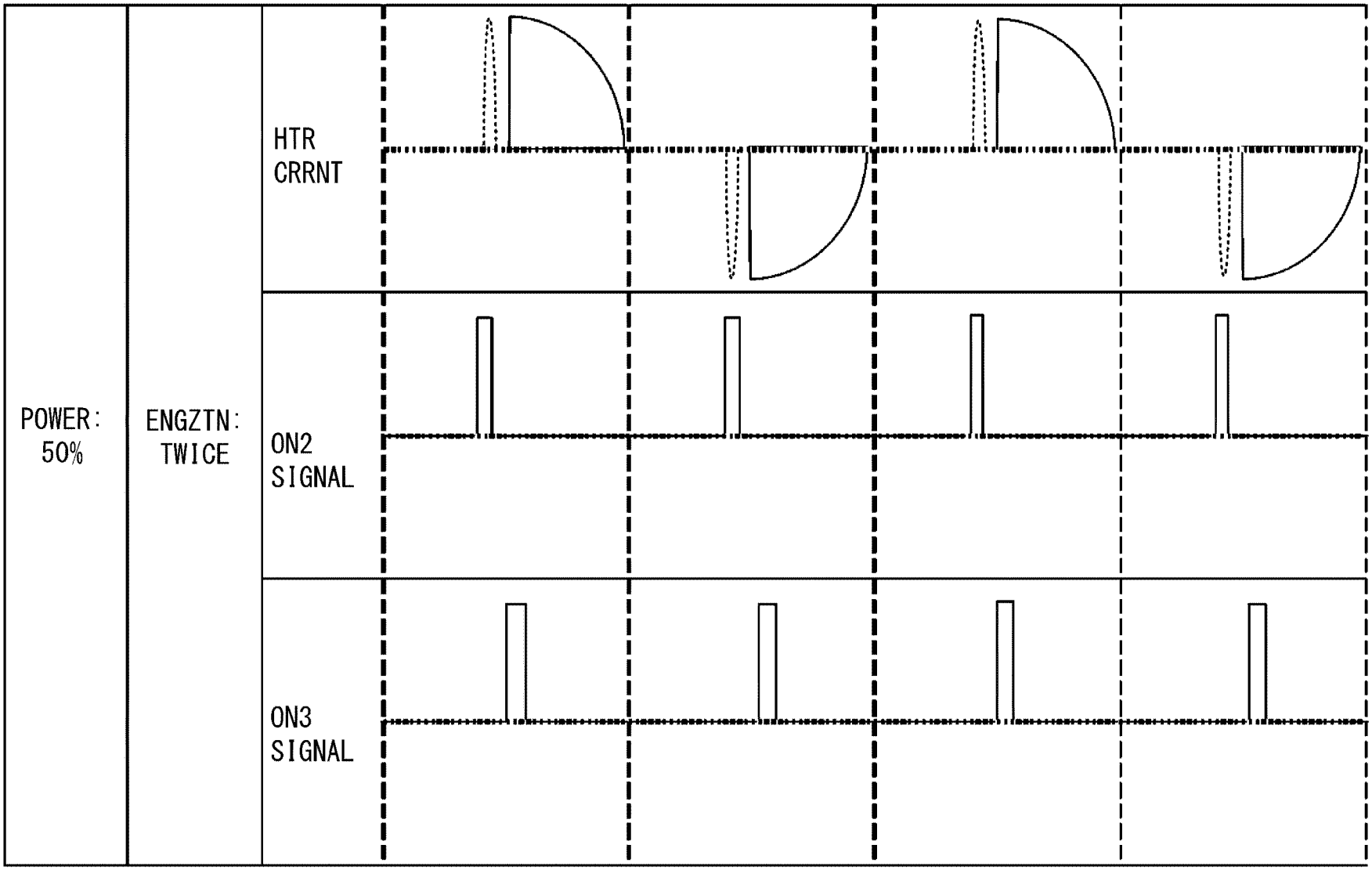

FIG. 11 is a schematic view showing a heater current waveform and a control signal in the embodiment 3.

DESCRIPTION OF THE EMBODIMENTS

In the following, embodiments for carrying out the present invention will be specifically described with reference to the drawings. The following embodiments are an example of the present invention, and a technical scope of the present invention is not intended to be limited thereto.

Embodiment 1

[Image Forming Apparatus]

Figure 1:
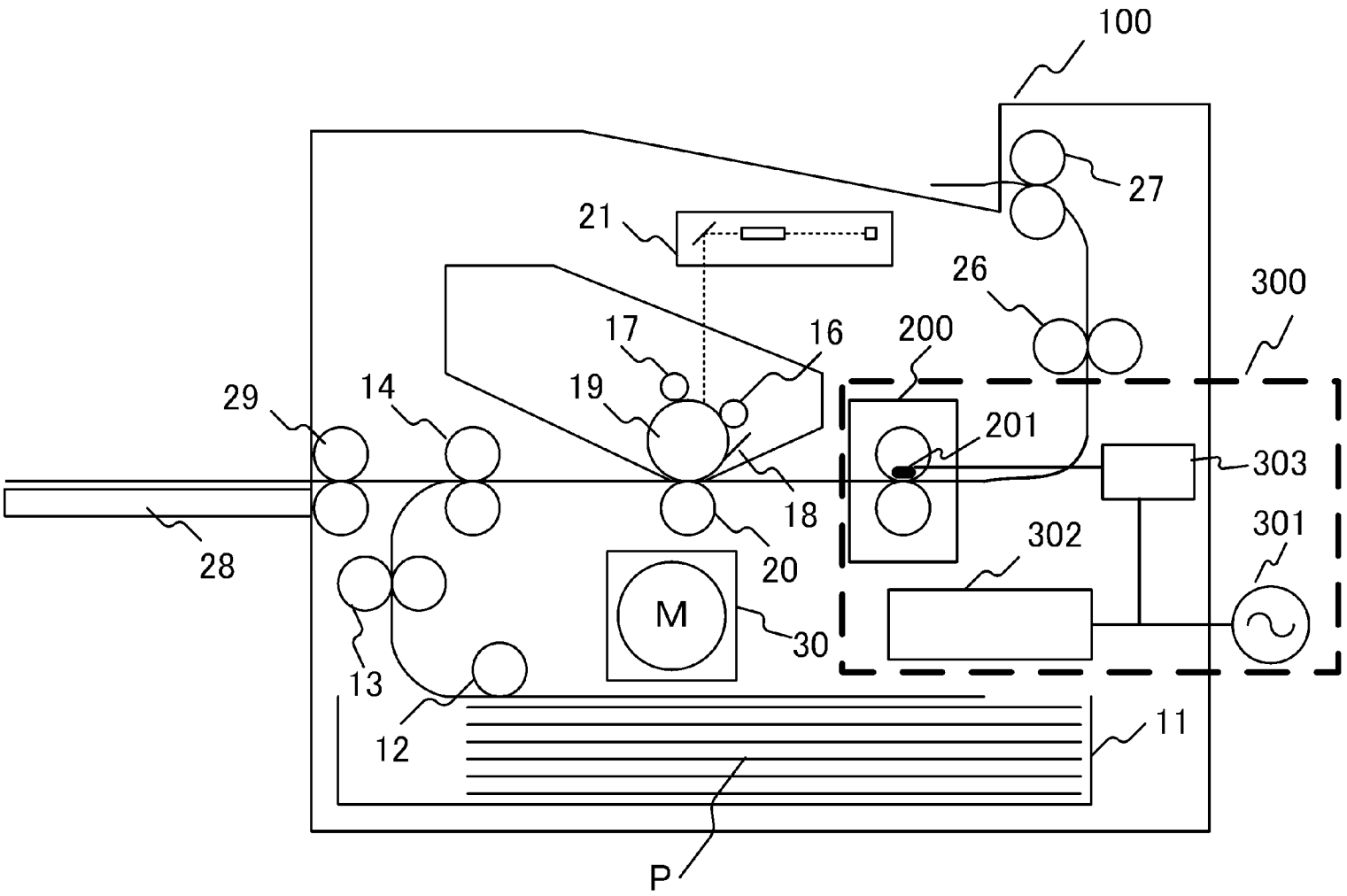
FIG. 1 is a schematic view for illustrating an image forming apparatus according to embodiments 1 to 3.

FIG. 1 is a sectional view of an image forming apparatus 100 using electrophotographic recording technique. When a print signal is generated, a scanner unit 21 emits laser light modulated depending on image information, so that a photosensitive drum 19 electrically charged to a predetermined polarity by a charging roller 16 is scanned with the laser light. By this, an electrostatic latent image is formed on the photosensitive drum 19. To this electrostatic latent image, toner is supplied from a developing device 17, so that a toner image depending on the image information is formed on the photosensitive drum 19. On the other hand, recording paper P stacked on a paper (sheet) feeding cassette 11 is fed one by one by pick-up roller 12 and is conveyed toward a registration roller pair 14 by a roller pair 13. Then, the recording paper P is conveyed from the registration roller pair 14 to a transfer position in synchronism with a timing when the toner image on the photosensitive drum 19 reduces the transfer position formed by the photosensitive drum 19 and a transfer roller 20. In a process in which the recording paper P passes through the transfer position, the toner image on the photosensitive drum 19 is transferred onto the recording paper P.

Thereafter, the recording paper P is heated by a heater 201 in an image heating apparatus 200, so that the (unfixed) toner image is heat-fixed on the recording paper P. The recording paper P carrying the fixed toner image is discharged onto a tray at an upper portion of the image forming apparatus 100 by roller pairs 26 and 27. Incidentally, a cleaner 18 cleans the photosensitive drum 19. A paper feeding tray (manual feeding tray) 28 is a tray including a pair of recording paper regulating plates (not shown) capable of adjusting a width of the recording paper P depending on a size of the recording paper P. Incidentally, the width refers to a length of the recording paper P with respect to a direction substantially perpendicular to a feeding direction of the recording paper P. The paper feeding tray 28 is provided so as to meet also recording paper P with a size other than regular sizes. A pick-up roller pair 29 is a roller pair for feeding the recording paper P from the paper feeding tray 28. A motor 30 is a motor for driving the image heating apparatus 200 or the like. A power source circuit 302 connected to a commercial AC power source 301 supplies power (electric power) to the motor 30. To the heater 201 in the image heating apparatus 200, the power is supplied by control of a control circuit 303 connected to the AC power source 301. The photosensitive drum 19, the charging roller 16, the scanner unit 21, the developing device 17, and the transfer roller 20 which are described above constitute an image forming portion for forming the (unfixed) toner image on the recording paper P. Incidentally, hereinafter, the image heating apparatus 200, the AC power source 301, the power source circuit 302, and the control circuit 303 are also referred to as a peripheral portion 300.

[Image Heating Apparatus]

Figure 2:
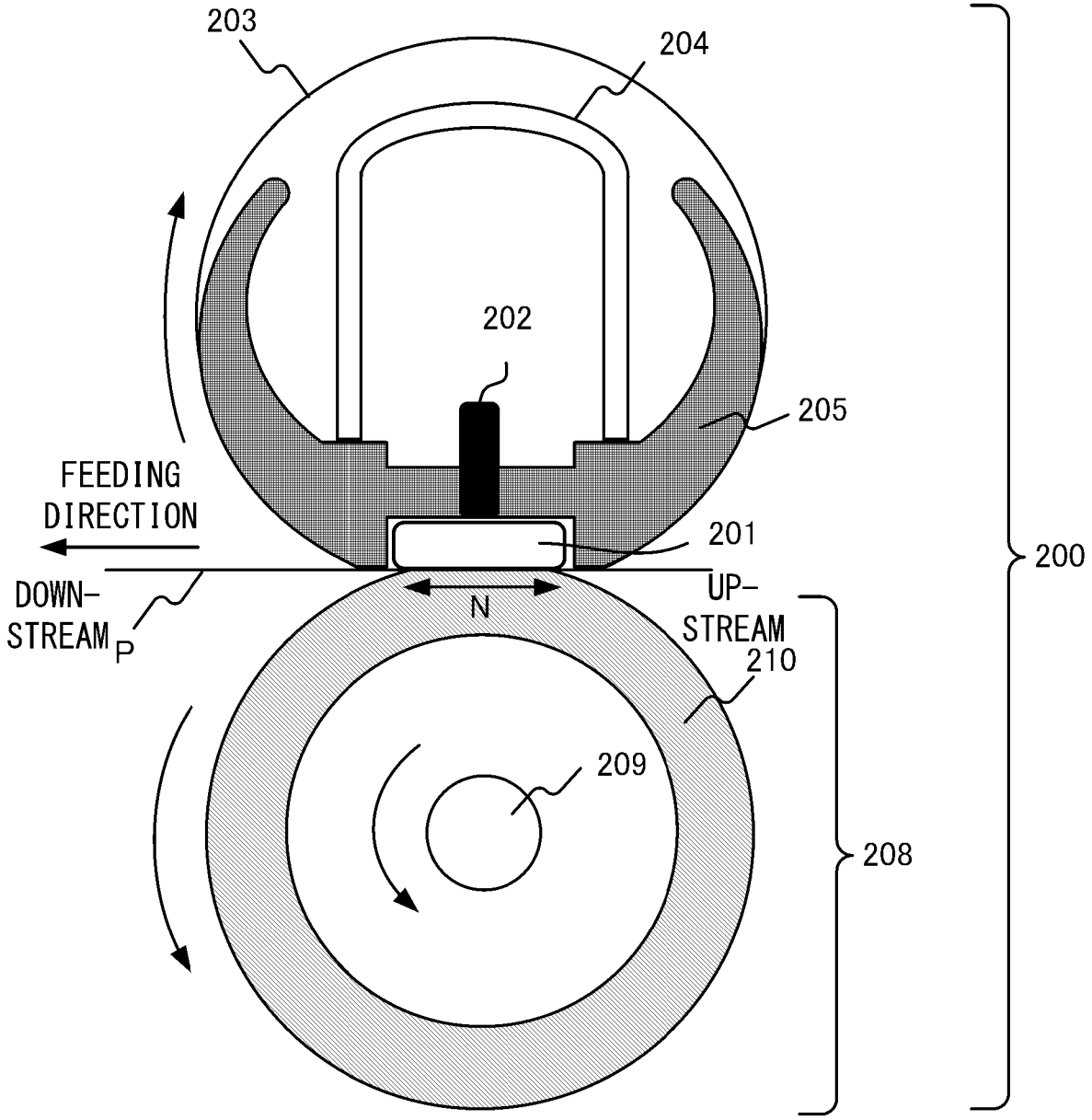
FIG. 2 is a sectional view of an image heating apparatus in the embodiments 1 to 3.

FIG. 2 is a sectional view of the image heating apparatus 200 in the embodiment 1. The image heating apparatus 200 includes a film 203, the heater 201, a pressing roller 208, and a thermistor 202. The film 203 is constituted in the form of a cylindrical film as an endless belt. The heater 201 contacts an inner surface of the film 203. The pressing roller 208 which is a nip forming member forms a fixing nip N in cooperation with the heater 201 through the film 203. The thermistor 202 which is a temperature detecting portion is a temperature detecting element for detecting a temperature of the heater 201.

A material of a base layer of the film 203 is, for example, a heat-resistant resin material such as polyimide or metal such as stainless steel. Further, as a surface layer of the film 203, an elastic layer of a heat-resistant rubber or the like may also be provided. The pressing roller 208 includes a core metal 209 made of a material such as iron or aluminum and an elastic layer 210 made of a material such as a silicone rubber, for example. The heater 201 is held by a holding member 205 made of a heat-resistant resin material. The holding member 205 also has a guiding function of guiding rotation of the film 203. A stay 204 is a stay made of metal for applying pressure of a spring (not shown) to the holding member 205. The pressing roller 208 is rotated in an arrow direction (counterclockwise direction) by receiving motive power from a motor (not shown). By rotation of the pressing roller 208, the film 203 is rotated in an arrow direction (clockwise direction). The recording paper P carrying thereon the (unfixed) toner image is heated and subjected to a fixing process while being nipped and fed in the fixing nip N. In FIG. 2, the recording paper P is fed from a right-hand side (also an upstream side) to a left-hand side (also a downstream side), and this direction is hereinafter referred to as a feeding direction.

[Heater Driving Circuit]

Figure 3:
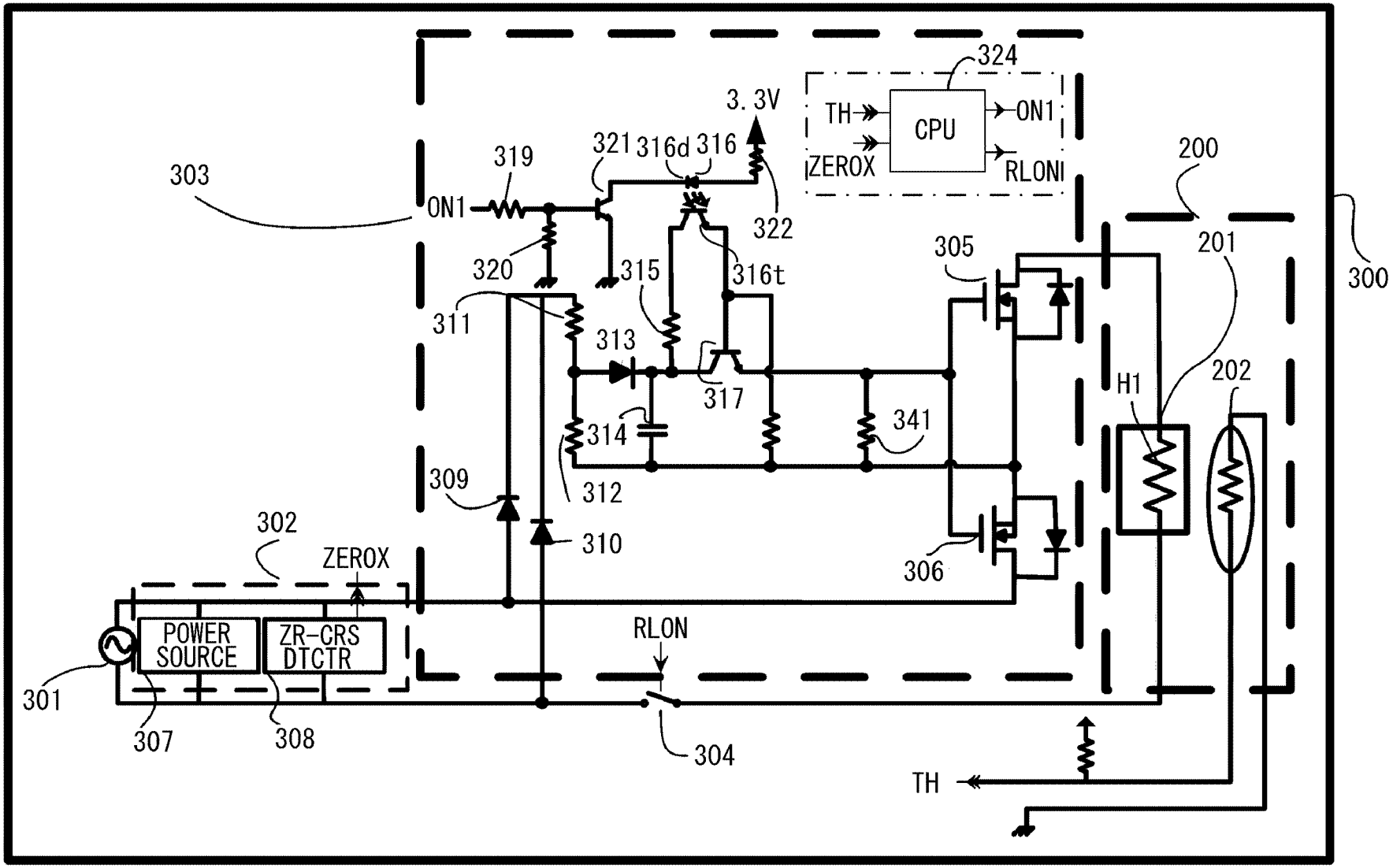
FIG. 3 is a schematic view of a heater control circuit using an FET (field-effect transistor) in the embodiment 1.

FIG. 3 shows an example of the control circuit 303 of the heater 201 and the peripheral portion 300 thereof in the embodiment 1. The peripheral portion 300 shows a circuit for supplying power, supplied from the AC power source 301, to a heat generating element H1 of the heater 201 through a relay 304 by conduction (hereinafter referred to as ON) of a field-effect transistor (hereinafter referred to as a FET) 305 and an FET 306.

By control of a conduction state/non-conduction state (hereinafter referred to as ON/OFF) of the FET 305 and the FET 306 which are switching elements connected in parallel to the heat generating element H1, power supply (hereinafter referred to as energization)/power cut-off to the heat generating element H1 is carried out. ON/OFF of each of the FET 305 and the FET 306 is carried out by controlling a voltage applied to a gate terminal of each of the FET 305 and the FET 306. First, the voltage supplied from the AC power source 301 is supplied to the power source circuit 302 and the control circuit 303 connected in parallel. The power source circuit 302 includes a power source device 307 for driving the motor 30 and the like and includes a zero-cross detecting circuit 308 which is a zero-cross detecting portion for detecting a zero-cross point and for outputting a zero-cross signal ("ZEROX" in FIG. 3).

The voltage supplied to the control circuit 303 is rectified by a diode 309 and a diode 310. The rectified voltage is divided by a resistor 311 and a resistor 312, and the divided voltage is supplied to an electrolytic capacitor 314 via a diode 313, so that a DC voltage Vcc (hereinafter also referred to as a power source voltage Vcc) is generated. Then, the power source voltage Vc charged in the electrolytic capacitor 314 supplies a current to a base terminal of a transistor 317 via a resistor 315 and a photo-coupler 316.

A driving signal ON1 for the heater 201 outputted by an operation of a CPU 324 which is a controller described later causes the current to flow through a base terminal of a transistor 321 via a resistor 319. By this, the current is supplied from a power source of 3.3 V to a light emitting diode 316*d* of a photo-coupler 316 via a resistor 322. When the current is supplied to the light emitting diode 316*d* of the photo-coupler 316, a photo-transistor 316*t* of the photo-coupler 316 is turned on. The driving signal ON1 (hereinafter also referred to as ON1 signal) is connected to the ground (hereinafter referred to as GND) via a resistor 320. By the above-described constitution, the current in conformity to switching of the driving signal ON1 is supplied to the base terminal of the transistor 317.

To the base terminal of the transistor 317, the current is supplied from the electrolytic capacitor 314 in synchronism with the driving signal ON1. In a time in which the current is supplied, the transistor 317 is turned on, so that a voltage is supplied from the electrolytic capacitor 314 to gate terminals of the FET 305 and the FET 306. Then, by a resistor 341 between a gate and a source common to the FET 305 and the FET 306, a potential difference generates between the gate and the source of each of the FET 305 and the FET 306, so that the FET 305 and the FET 306 are turned on. By this, the current flows through the heat generating element H1. Incidentally, supply of the DC voltage Vcc to the electrolytic capacitor 314 may also be made by supply from, for example, an external power source or may also be made from a switching transformer (not shown) of the power source device 307.

[CPU 324]

The CPU 324 of the controller 303 outputs the ON1 signal, for driving the heater 201, to the control circuit 303. The CPU 324 outputs an RLON signal to the relay 304 in order to control a connection state or a non-connection state of the relay 304. To the CPU 324, a TH signal indicating a temperature of the heater 201 which is a detection result of the thermistor 202 and a ZEROX signal outputted from the zero-cross detecting circuit 308 are inputted. In the CPU 324, an actual temperature of the heater 201 acquired on the basis of the inputted TH signal and a target temperature of the heater 201 set inside the CPU 324 are compared with each other. As a result of the comparison, the CPU 324 determines a supply duty for each of control cycles (cyclic periods) required for the temperature of the heater 201 reduces the target temperature. Here, each control cycle is an integral multiple of a zero-cross cycle, for example. Further, the supply duty refers to a ratio (power ratio) of power to be supplied within the control cycle in order that the temperature of the heater 201 reduces the target temperature, and hereinafter is referred to as first (electric) power. The CPU 324 outputs the driving signal ON1, for driving the heater 201, on the basis of the first power determined based on the through signal and on the basis of the ZEROX signal which is a timing signal.

[Control Method of Heater Current]

A control method of a heater current during a printing operation in the embodiment 1 will be described. The embodiment 1 is characterized in that phase control is carried out and the heater is turned on a plurality of times within a half cycle of the AC power source 301, in other words, within single half wave of the AC voltage. In the following description, a frequency of the AC power source 301 is, for example, 50 Hz, and one cycle is 20 ms (the single half wave is 10 ms). At this time, in the case where the power of 100% is supplied within the single half wave, a time in which energization is performed (hereinafter referred to as an energization time) is 10 ms.

Each of parts (a) to (c) of FIG. 4 shows a waveform of a heater current (hereinafter referred to as a harmonic current waveform) and a waveform of the ON1 signal which is a control signal in the embodiment 1. In each of graphs of parts (a) to (c) of FIG. 4, from a leftmost column, supplied power (%), an energization period (ms) in a first power supply period described later, the number of times of energization (hereinafter referred to as the number of energization) in the first power supply period, the heater current waveform, and the ON1 signal waveform are shown. In either graph, the case where the power supplied in one control cycle (i.e., the supplied power) is 50% when the supplied power in full energization is 100% is shown. Incidentally, each of t1 to t18 represents a point of time (or a timing), and in the following, t1 or the like means a point of time t1 (or a timing t1) or the like. Further, for example, t1 to t2 or the like means a time (or a period) from the point of time t1 to a point of time t2, or the like.

In part (a) of FIG. 4, in the single half wave of the AC voltage, the current is caused to flow through the heater 201 in a period of t1 to t2 and a period of t3 to t4, and this control is repeated. Incidentally, for example, on the basis of raising (or lowering) of the ZEROX signal inputted from the zero-cross detecting circuit 308, the CPU 324 carries out control in which the ON1 signal is set at a high level at t1 or t3 by making reference to a timer (not shown) included therein or the like. Further, for example, on the basis of raising (or lowering) of the ZEROX signal inputted from the zero-cross detecting circuit 308, the CPU 324 carries out control in which the ON1 signal is set at a low level at t2 or t4 by making reference to a timer (not shown) or the like. Also, in the following description, the CPU 324 carries out similar control and thus performs control of the ON1 signal and the heater current.

(Definition of Periods)

The period of t1 to t2 is set at a time within a range from 1/40 time (for example, 0.5 ms) to 1/6000 time (for example, 0.003 ms) the one period time (for example, 20 ms) at a predetermined frequency of the AC power source 301. The period of t1 to t2 is hereinafter referred to as the first power supply period or a first energization period. Incidentally, the first energization period refers to an energization period in the first power supply period, and in part (a) of FIG. 4, the first energization period is one which is the period of t1 to t2, and therefore, the first energization period is the same period as the first power supply period. On the other hand, the period of t3 to t4 is set so that power corresponding to a difference between "first power determined by the CPU" and "power supplied in the first power supply period" is supplied. The period of t3 to t4 refers to a second power supply period. Further, a period of t2 to t3 is set at a time within a range from 1/40 time to 1/6000 time the one period time at the predetermined frequency of the AC power source 301. The period of t2 to t3 is a period between the first power supply period and the second power supply period, and is hereinafter referred to as a power supply interruption period. As a result, the referring number of energization is twice in the single have wave.

Part (a) of FIG. 4 shows the case of the supplied power of 50%, and each of the first power supply period of t1 to t2 and the power supply interruption period of t2 to t3 which is the period between the first power supply period and the second power supply period was set at 0.1 ms. The second power supply period of t3 to t4 was set at 4.9 ms. That is, the first power supply period of t1 to t2 was a time shorter than the second power supply period of t2 to t4. The power supply interruption period of t2 to t3 is a time which is substantially same as the first power supply period of t1 to t2 and which is shorter than the second power supply period of t3 to t4.

In part (b) of FIG. 4, the current is applied to the heater 201 in each of the periods of t5 to t6, t7 and t8, and t9 to t10. Part (b) of FIG. 4 shows a heater current waveform and a waveform of a control signal in the case where compared with the case of part (a) of FIG. 4, the number of first energization periods (the number of energization) in a range from 1/40 time to 1/6000 time the one cycle time of the frequency is changed. In part (b) FIG. 4, the first power supply period is a period of t5 to t8, and the second power supply period is a period of t9 to t10. In the first power supply period of t5 to t8, the period of t5 to t6 is a first energization period and the period of t7 to t8 is a second energization period. Each of the periods of t5 to t6, t6 to t7, t7 to t8, and t9 to t9 was set at 0.1 ms. The period of t9 to t10 was set at 4.8 ms. As a result, the number of energization is three times.

In part (c) of FIG. 4, the current is applied to the heater 201 in each of the periods of t11 to t12, t13 to t14, t15 and t16, and t17 to t18. Part (c) of FIG. 4 shows a heater current waveform and a waveform of a control signal in the case where compared with the cases of parts (a) and (b) of FIG. 4, the number of energization periods (the number of energization) in a range from 1/40 time to 1/6000 time the one cycle time of the frequency of the AC power source 301 is changed. In part (c) FIG. 4, the first power supply period is a period of t11 to t16, and the second power supply period is a period of t17 to t18. In the first power supply period of t11 to t16, the period of t11 to t12 is a first energization period, the period of t13 to t14 is a second energization period and the period of t15 to t16 is a third energization period. Each of the periods of t11 to t12, t12 to t13, t13 to t14, t14 to t15, t15 to t16, and t16 to t17 was set at 0.1 ms. The period of t17 to t18 was set at 4.7 ms. As a result, the number of energization is four times. In the above, the waveforms in the case where the energizations number of energization in the range from 1/40 time to 1/6000 time the one cycle time of the frequency of the AC power source 301 were described. In parts (a) to (c) of FIG. 4, the CPU 324 carries out the control, at least one time, in which the FETs 305 and 306 are put in the conduction state, for example, for 0.1 ms which is a first time in the first power supply period.

As shown in parts (a) to (c) of FIG. 4, the CPU 324 controls the conduction state or the non-conduction state of the FETs 305 and 306 so that a period in which the power is supplied to the heater 201 in the single half wave is divided into at least two periods and the power is supplied to the heater 201. Further, the CPU 324 divides the period in which the power is supplied to the heater 201 into at least one first power supply period and a second power supply period longer than one first power supply period. Further, a length of a sum of all the power supply periods is a length in a range from 1/6000 to 1/40 of one cycle of the AC power source 301. Further, a sum of the power supplied in all the power supply periods and the diode supplied in the second power supply period is power determined depending on a difference between the temperature of the fixing portion and the target temperature.

[Change in Energization Period]

Next, a waveform in the case where the energization period is changed while fixing the energizations number of energization will be described. Similarly as in the cases of parts (a) to (c) of FIG. 4, each of parts (a) to (c) of FIG. 5 shows the case where the power of 50% of the power during the full energization is supplied. Parts (a) to (c) of FIG. 5 are graphs similar in constitution as those of parts (a) to (c) of FIG. 4. In control of each of parts (a) to (c) of FIG. 5, the Similarly, number of energization in the range from 1/40 time to 1/6000 time the one cycle time of the frequency of the AC power source 301 is fixed at one time. For this reason, in this control, the energization period in the first power supply period is only the first energization period. Further, the energizations number of energization in the single halfwave is fixed at twice. Further, the first energization period (i.e., the first power supply period) and the power supply interruption period between the first power supply period and the second power supply period are changed.

In part (a) of FIG. 5, the first power supply period, in other words, the first energization period is a period of t1 to t2, and the second power supply period is a period of t3 to t4. In part (a) of FIG. 5, each of the first power supply period of t1 to t2 and the power supply interruption period of t2 to t3 was set at 0.107 ms. The second power supply period of t3 to t4 was set at 4.893 ms. The energizations number of energization is twice as described above.

In part (b) of FIG. 5, the first power supply period, in other words, the first energization period is a period of t5 to t6, and the second power supply period is a period of t7 to t8. In part (b) of FIG. 5, each of the first power supply period of t5 to t6 and the power supply interruption period of t6 to t7 was set at 0.115 ms. The second power supply period of t7 to t8 was set at 4.885 ms. The energizations number of energization is twice as described above.

In part (c) of FIG. 5, the first power supply period, in other words, the first energization period is a period of t9 to t10, and the second power supply period is a period of t11 to t12. In part (c) of FIG. 5, each of the first power supply period of t9 to t10 and the power supply interruption period of t10 to t11 was set at 0.123 ms. The second power supply period of t11 to t12 was set at 4.877 ms. The energizations number of energization is twice as described above. In the above, the change in waveform in the case where the energization period and the period between the first power supply period and the second power supply period were changed was described. In parts (a) to (c) of FIG. 5, in the first power supply period, the CPU 324 changes the first time in which the FETs 305 and 306 are put in the conduction state is changed.

(Harmonic Current Reducing Effect 1)

FIG. 6 is a schematic view showing a heater current waveform and a waveform of the ON1 signal when the power of 50% is supplied in the case where the control of the embodiment 1 is not carried out, and includes a graph similar in constitution to those of parts (a) to (c) of FIG. 4 and parts (a) to (c) of FIG. 5. In the case where the control of the embodiment 1 is not carried out, the power is supplied in the period of t1 to t2, and the number of energization is once. FIG. 6 is shown for making comparison study with the control of the embodiment 1 below. Part (a) of FIG. 7 is a graph showing a measurement result of a harmonic current when the heater 201 is controlled by the heater current waveform of each of parts (a) to (c) of FIG. 4 and FIG. 6, in which the abscissa represents orders of the harmonic current and the ordinate represents a ratio of a magnitude of the harmonic current in each order to a standard value of the harmonic current in associated order (current value/standard value). The standard value refers to a value defined by equipment of Class A in accordance with IEC 61000-6-3. The case where control of part (a) of FIG. 4 is carried out is represented by ● and a broken line, the case where control of part (b) of FIG. 4 is carried out is represented by ■ and a dotted line, and the case where control of part (c) of FIG. 4 is carried out is represented by ▲ and a solid line. Further, the case of FIG. 6 in which the control of the embodiment 1 is not carried out is represented by x and the solid line.

It is understood that a result of the case where the control of the embodiment 1 is carried out (waveforms of parts (a) to (c) of FIG. 4 (change in the number of energization)) is reduced in harmonic current than a result of the case where the control of the embodiment 1 is not carried out (waveform of FIG. 6). This is because by the presence of the energization period within the range from 1/40 time to 1/6000 time the one cycle time of the frequency of the AC power source 301, the order of the harmonic current enhanced is shifted to a high order side of 40 (order) or more. Further, from the results of parts (a) to (c) of FIG. 4, it is understood that a harmonic current reducing effect is different depending on the order of the harmonic current. For example, the harmonic current reducing effect is 50% or less each in the neighborhood of the order of 30 in part (a) of FIG. 4 (the number of energization: once), in the neighborhood of the order of 20 in part (b) of FIG. 4 (the number of energization: twice), and in the neighborhood of the order of 10 in part (c) of FIG. 4 (the number of energization: three times). This represents that the order of the harmonic current enhanced changes due to a difference in the number of energization within the range from 1/40 time to 1/6000 time the one cycle time of the frequency of the AC power source 301, and therefore, the order of the harmonic current reduced changes. Depending on the order of the harmonic current intended to be reduced, there is a need to change the energizations number of energization within the range from 1/40 time to 1/6000 time the one cycle time of the frequency of the AC power source 301.

Incidentally, in parts (a) to (c) of FIG. 4, in the first power supply period, all the length of the energization period within the range from 1/40 time to 1/6000 time the one cycle time of the frequency of the AC power source 301, the length of a period between a preceding period and a subsequent period, and the length of the power supply interruption period was set at 0.1 ms. However, depending on the order of the harmonic current intended to be reduced, each of the length of the energization period within the range from 1/40 time to 1/6000 time the one cycle time of the frequency of the AC power source 301, the length of the period between the preceding period and the subsequent period, and the length of the power supply interruption period may also be changed.

(Harmonic Current Reducing Effect 1)

Part (b) of FIG. 7 is a graph showing a measurement result of a harmonic current with the heater current waveform of each of parts (a) to (c) of FIG. 5 and FIG. 6, in which the abscissa represents orders of the harmonic current and the ordinate represents a ratio of a magnitude of the harmonic current in each order to a standard value of the harmonic current in associated order (current value/standard value). The case where control of part (a) of FIG. 5 is carried out is represented by ● and a broken line, the case where control of part (b) of FIG. 5 is carried out is represented by ■ and a dotted line, and the case where control of part (c) of FIG. 5 is carried out is represented by ▲ and a solid line. Further, the case of FIG. 6 in which the control of the embodiment 1 is not carried out is represented by x and the solid line.

It is understood that a result of the case where the control of the embodiment 1 is carried out (waveforms of parts (a) to (c) of FIG. 5 is reduced in harmonic current compared with a result of the case where the control of the embodiment 1 is not carried out (waveform of FIG. 6). This is because by the first energization period, the order of the harmonic current enhanced is shifted to a high order side of 40 (order) or more. Further, from the results of parts (a) to (c) of FIG. 5, it is understood that a harmonic current reducing effect is different depending on the order of the harmonic current. For example, the harmonic current reducing effect is 40% or less in the neighborhood of the order of 35 in part (a) of FIG. 5 (energization period: 0.107 ms). Further, the harmonic current reducing effect is 20% or less each in the neighborhood of the order of 30 in part (b) of FIG. 5 (energization period: 0.115), and in the neighborhood of the order of 25 in part (c) of FIG. 4 (energization period: 0.123). This represents that the order of the harmonic current enhanced changes due to a difference in length of first energization period or length of the power supply interruption period, and therefore, the harmonic current reducing effect is different. For this reason, depending on the order of the harmonic current intended to be reduced, there is a need to change the length of the first energization period or the power supply interruption period. In parts (a) to (c) of FIG. 5, the first energization period and the power supply interruption period were made equal to each other. Here, these periods were set at 0.107 ms in part (a) of FIG. 5, at 0.115 ms in part (b) of FIG. 5, and at 0.123 ms in part (c) of FIG. 5. However, depending on the order of the harmonic current intended to be reduced, the length of the first energization period and the length of the power supply interruption period may also be changed.

In the embodiment 1, the first power was limited to 50% and description was made. However, the first power is not required to be limited to 50%, but even when the value of the first power is another value, the embodiment 1 is applicable thereto. In the case where the first power changes, the first energization period, the equal number of energization within the range from 1/40 time to 1/6000 time the one cycle time of the frequency of the AC power source 301, or the length of the power supply interruption period is not limited to those in the embodiment 1. These number of times and periods change depending on a supply duty. Further, the single second power supply period was employed, but the second power supply period may also be divided into two or more second power supply periods. As described in the embodiment 1, the order in which the harmonic current generates is shifted to the high order side, so that the harmonic currents from the order of 3 to the order of 39 can be reduced.

As described above, according to the embodiment 1, the harmonic current can be reduced while suppressing the influence on the switching element.

Embodiment 2

(Power Source Circuit)

FIG. 8 is a schematic view showing a circuit constitution of a power source device 307 (power source) connected in parallel to a control circuit 303 for controlling an image heating apparatus 200. An AC voltage of the AC power source 301 is inputted to a diode bridge 901. The AC voltage is subjected to full-wave rectification by the diode bridge 901 and is thus smoothed by a smoothing capacitor 902. The smoothed voltage is inputted to a switching power source 903 which is a DC-DC capacitor, and the switching power source 903 outputs a secondary(-side) voltage. As the switching power source 903, an insulating transformer **903*t* is used for ensuring insulation between a primary side and a secondary side. A smoothing capacitor 904 is a capacitor for outputting the secondary voltage from the switching power source 903. A current It flowing from the AC power source 301 is branched into a current Ic flowing through the power source device 307 and a current Ih flowing through the image heating apparatus 200 via the control circuit 303**.

(Control Method)

Parts (a) and (b) of FIG. 9 are schematic views each showing the current Ic flowing through the power source device 307 and the current Ih flowing through the image heating apparatus 200 by control of the control circuit 303. The current indicated by a dotted line is the current Ic flowing through the power source device 307, and the current indicated by a solid line shows the current Ih flowing through the image heating apparatus 200. Part (a) of FIG. 9 shows a waveform in the case where control of the embodiment 2 is not carried out. It is understood that the current Ic and the current Ih timewise overlap with each other in the neighborhood of a phase angle of 90°. Thus, in the case where the current Ic and the current Ih timewise overlap with each other, the influence of a resultant current of the current Ic and the current Ih on the harmonic current increases.

On the other hand, part (b) of FIG. 9 shows a waveform in the case where the embodiment 2 is carried out. A total current of the current Ih in part (b) of FIG. 9 is not different from a total current of the current Ih in part (a) of FIG. 9. In the embodiment 2, the CPU 324 controls the current Ih so that the current Ic and the current Ih do not timewise overlap with each other. In addition, the CPU 324 carries out control in which the first power supply period and the second power supply period are provided as described in the embodiment 1. Here, the first power supply period is a period including the energization period within the range from 1/40 time to 1/6000 time the one cycle time of the frequency of the AC voltage. The second power supply period is a period in which power of a difference between "first power determined by the CPU 324" and "power supplied in the first power supply period". Specifically, in part (b) of FIG. 9, the first power supply period is a period of t3 to t8 and specifically includes a first energization period of t3 to t4, a second energization period of t5 to t6, and a third energization period of t7 to t8. A period of t4 to t5 and a period of t6 to t7 which are period, in which the energization is not performed, each between a preceding energization period and a subsequent energization period in the first power supply period are set at different times. Further, the second power supply period includes a period of t1 to t2 and a period of t9 to t10, and thus, in the embodiment 2, the second power supply period is divided into the two periods. For this reason, the power supply interruption period also includes two periods of t2 to t3 and t9 to t9, and lengths of these (two) power supply interruption periods may be the same or different from each other. By this, in part (b) of FIG. 9, the second power supply period of the current Ih is disposed so as not to overlap with the current Ic of the power source device 307 timewise (or in terms of phase). Thus, how to control each of the periods in the single half wave in what order may only be required to be set depending on the current Ic of the power source device 307.

By the above, the CPU 324 causes the current Ic and the current Ih so as not to timewise overlap with each other and subjects the current Ic flowing through the image heating apparatus 200 to control of the embodiment 2. By this, the harmonic current of the resultant current of the current Ic and the current Ih in part (b) of FIG. 9 is reduced than the harmonic current of the resultant current of the current Ic and the current Ih in part (a) of FIG. 9.

(Confirmation of Harmonic Current Reducing Effect)

Part (c) of FIG. 9 shows a measurement result of the harmonic current in part (a) of FIG. 9 and a measurement result of the harmonic current in part (b) of FIG. 9, in which the abscissa represents the order of the harmonic current and the ordinate represents a ratio of a magnitude of the harmonic current in each other to a standard value of the harmonic current in associated order (current value/standard value). The case where the control of part (a) of FIG. 9 is carried out is indicated by ● and a solid line, and the case where the control of part (b) of FIG. 9 is carried out is represented by ▲ and a broken line.

When the result of part (a) of FIG. 9 is confirmed, it is understood that the harmonic current due to the power source device 307 generates in the order of 3 and the order of 5. Here, the order of the harmonic current intended to be reduced in the embodiment 2 is determined as the order of 3 and the order of 5. Further, an optimum first power supply period, an optimum the number of energization within the range from 1/40 time to 1/6000 time the one cycle time of the frequency of the AC voltage, and an optimum power supply interruption period are set. By making setting as described above, a waveform of part (b) of FIG. 9, in which first power is the same as the power in a waveform of part (a) of FIG. 9 was prepared.

In the waveform of part (b) of FIG. 9, the first power supply period is the period of t3 to t8, and the second power supply period includes the period of t1 to t2 and t9 to t10. The period of t1 to t2 was set at 2.2631 ms. Each of the period of t2 to t3 and the period of t3 to t4 was set at 0.101 ms. The period of t4 to t5 was set at 2.6849 ms. Each of the periods t5 to t6, t6 to t7, t7 to t8, t8 to t9 was set at 0.1176 ms. The period of t9 to t10 was set at 4.3796 ms. Incidentally, the second power supply period is controlled (disposed) so that an AC current amount is in the neighborhood of a small phase angle of 0° (or 180°). For this reason, by carrying out the control using the number of milliseconds which are the above-described values, a total current amount of the current Ih of part (b) of FIG. 9 can be controlled so as to be substantially equal to a total current amount of the current Ih of part (a) of FIG. 9. Further, in the embodiment 1, the second power supply period is once within the time in the one cycle of the frequency of the AC voltage, but in the embodiment 2, the second power supply period is divided into two periods (twice) in order to satisfy the first power. When a result of part (c) of FIG. 9, it can be confirmed that the harmonic current is reduced in the result of the waveform of part (b) of FIG. 9 in which the control of the embodiment 2 is carried out than in the result of the waveform of part (a) of FIG. 9 in which the control of the embodiment 2 is not carried out. Specifically, in the case of part (b) of FIG. 9, the ratio (current value/standard value) is 40% or less in the order of 3 and in the order of 5.

In the case where the first power changes, the first power supply period or the number of energization within the range from 1/40 time to 1/6000 time the one cycle time of the frequency of the AC voltage changes without being limited to those in the embodiment 2. Further, the period between an energization period and an adjacent energization period in the first power supply period or the number of times of division of the second power supply period changes without being limited to those in the embodiment 2. As described above in the embodiment 2, the order in which the harmonic current generates is shifted to the high order side, even in the case where a resultant current of a charging current into an input capacitor of the switching power source is taken into consideration, the harmonic current can be reduced.

As described above, according to the embodiment 2, the harmonic current can be reduced while suppressing the influence on the switching element.

Embodiment 3

(Circuit Constitution in Which Two Triacs are Connected in Parallel to Each Other)

FIG. 10 shows an example of a control circuit 303 of a heater 201 and a peripheral portion 300 thereof in the embodiment 3. In the embodiment 1, the power was supplied to the heat generating element H1 by using the FETs (305 and 306). In the embodiment 3, as the switching element, bidirectional thyristors (hereinafter referred to as triacs) 1201 and 1202 are used and are subjected to ON/OFF control, so that energization and cut-off of energization are carried out. ON/OFF of the triac 1201 which is a first bidirectional thyristor is carried out by controlling the current flowing through a light emitting diode 1203*d* of a photo-triac coupler 1203. The triac 1201 is connected to the heater 201 in series. To the triac 1201, a capacitor 1206 is connected in series. ON/OFF of the triac 1202 which is a second bidirectional thyristor is carried out by controlling the current flowing through a light emitting diode 1204*d* of a photo-triac coupler 1204. The triac 1202 is connected in parallel to the triac 1201 and the capacitor 1206 which are connected to each other in series.

First, the voltage supplied from the AC power source 301 to the control circuit 303 is supplied to the capacitor 1206 and the triac 1202 via a capacitor C600 and an inductor 1205. The charging current into the capacitor 1206 supplies power to the heat generating element H1 in synchronism with turning-on of the triac 1201. To a gate terminal of the triac 1201, a current flows via a resistor 1210 when the photo-triac coupler 1203 is turned on. The current via the resistor 1210 flows through the heat generating element H1 via a resistor 1211. By turning on the photo-triac coupler 1203, the triac 1201 is turned on. The photo-triac coupler 1203 is turned on by energization of the light emitting diode 1203*d*. To a cathode terminal of the light emitting diode 1203*d* of the photo-triac coupler 1203, in synchronism with a base current of a transistor 1207, a current flows from a power source of 3.3 V via a resistor 1219. Switching of the base current of the transistor 1207 is synchronized with a control signal ON2 (hereinafter also referred to as a ON2 signal) via a resistor 1208. The control signal ON2 is connected to the GND via a resistor 1209. The control signal ON2 is outputted from the CPU 324. By the above, the triac 1201 is turned on by the control signal ON2.

The supply of the power to the heat generating element H1 by the triac 1201 is made only by an amount of electric charge charged in the capacitor 1206. The amount of electric charge charged in the capacitor 1206 can be set at a value smaller than full power supplied to the heat generating element H1. Therefore, the first power supply period in the embodiment 1 can be constituted by the amount of electric charge charged in the capacitor 1206. In synchronism with a charging time of the capacitor 1206, the control signal ON2 is turned off. The charging is ended, and therefore, the triac 1201 can be turned off.

The voltage supplied to the triac 1202 is supplied to the heat generating element H1 by being turned on and off by a control signal ON3 (hereinafter also referred to as ON3 signal) outputted from the CPU 324 similarly as in the control of the above-described triac 1201. To a gate terminal of the triac 1202, a current flows via a resistor 1216 when a photo-triac coupler 1204 is turned on. The current via the resistor 1216 flows through the heat generating element H1 via a resistor 1217. By turning on the photo-triac coupler 1204, the triac 1202 is turned on. The photo-triac coupler 1204 is turned on by energization of the light emitting diode 1204*d*. To a cathode terminal of the light emitting diode 1204*d* of the photo-triac coupler 1204, in synchronism with a base current of a transistor 1215, a current flows from a power source of 3.3 V via a resistor 1212. Switching of the base current of the transistor 1215 is synchronized with a control signal ON3 via a resistor 1213. The control signal ON3 is connected to the GND via a resistor 1214. By the above, the triac 1202 is turned on by the control signal ON3. The supply of the power to the heat generating element H1 by the triac 1202 provides a dominant ratio in full power supplied to the heat generating element H1, and therefore, can constitute the second power supply period in the embodiment 1. Other constitutions are similar to those in FIG. 3, and thus will be omitted from description.

[Control of Embodiment 3]

FIG. 11 shows a waveform of each of the heater current waveform, the ON2 signal, and the ON3 signal in the circuit of FIG. 10. The case where supply power of 50% to full energization is supplied is shown. In the heater current waveform, a waveform constituted by the turning-on of the triac 1201 is a portion indicated by a dotted line and constitutes the first power supply period in the embodiment 1. A waveform constituted by the turning-on of the triac 1202 is a portion indicated by a solid line and constitutes the second power supply period in the embodiment 1. The like number of energization is twice. Other constitutions are similar to those of the embodiment 1 and will be omitted from description.

In the embodiment 3, the two triac 1201 and 1202 are connected in parallel to each other, and the single capacitor 1206 is connected to the single triac 1201, so that the first power supply period in the embodiment 1 is constituted. On the other hand, the other triac 1202 constitutes the second power supply period in the embodiment 1, so that it was shown that the control described in the embodiment 1 can be realized. Incidentally, even when the control as shown in each of parts (b) and (c) of FIG. 4, FIG. 5, and part (b) of FIG. 9 is carried out, it may only be required that the triac 1201 connected in parallel to the capacitor 1206 is turned on in the first power supply period and that the triac 1202 is turned on in the second power supply period.

As described above, according to the embodiment 3, the harmonic current can be reduced while suppressing the influence on the switching element.

Incidentally, in the above-described embodiments, the image heating apparatus 200 including the single heat generating element H1 was described, but the control of each of the embodiments is also applicable to the case where two or more heat generating elements are used, and a similar effect is achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-133163 filed on Aug. 5, 2020, which is hereby incorporated by reference herein in its entirety.

What is claimed is:

1. An image forming apparatus for forming a toner image on a recording material, comprising:

a fixing unit configured to heat and fix the toner image on the recording material, said fixing unit including a heater;

a switching element configured to switch between a conduction state in which electric power from an AC power source is supplied to said heater and a non-conduction state in which supply of the electric power to said heater is cut off; and a controller configured to control said switching element so as to maintain a temperature of said fixing unit at a target temperature, said controller controlling said switching element on a half-cycle basis of an alternating current so that electric power determined depending on a difference between the temperature of said fixing unit and the target temperature is supplied to said heater, wherein a period in which the electric power is supplied to said heater within a period of a half-cycle of the alternating current is divided into at least one first power supply period and a second power supply period longer than one first power supply period, wherein a length of a sum of all of said first power supply period is a length from 1/6000 to 1/40 of one cycle of the alternating current, and wherein a sum of electric power supplied in all of said first power supply period and electric power supplied in said second power supply period is determined depending on the difference between the temperature of said fixing unit and the target temperature.

2. An image forming apparatus according to claim 1, wherein said controller controls said switching element so that said first power supply period appears a plurality of times in the half-cycle of the alternating current, and wherein all said first power supply periods have the same length.

3. An image forming apparatus according to claim 1, wherein said controller controls said switching element so that said at least one first power supply period appears only once in the half-cycle of the alternating current, and wherein lengths of said at least one first power supply period are different from each other depending on the electric power determined depending on the difference between the temperature of said fixing unit and the target temperature.

4. An image forming apparatus according to claim 1, wherein said switching element is a field-effect transistor connected to said heater in series.

5. An image forming apparatus according to claim 1, wherein said switching element is a bidirectional thyristor.

6. An image forming apparatus according to claim 5, further comprising:

a first bidirectional thyristor connected to said heater in series;

a capacitor connected to said first bidirectional thyristor in series; and a second bidirectional thyristor connected in parallel to said first bidirectional thyristor and said capacitor which are connected to each other in series, wherein said controller carries out control by using said first bidirectional thyristor when the electric power is supplied to said heater in said at least one first power supply period, and carries out control by using said second bidirectional thyristor when the electric power is supplied to said heater in said second power supply period.

7. An image forming apparatus according to claim 1, further comprising a power source connected to said AC power source, wherein said control controls said switching element so that said second power supply period does not overlap with a period in which a current flows through said power source.

8. An image forming apparatus for forming a toner image on a recording material, comprising:

a fixing unit configured to heat and fix the toner image on the recording material, said fixing unit including a heater;

a switching element configured to switch between a conduction state in which electric power from an AC power source is supplied to said heater and a non-conduction state in which supply of the electric power to said heater is cut off; and a controller configured to control said switching element so as to maintain a temperature of said fixing unit at a target temperature, said controller controlling said switching element on a half-cycle basis of an alternating current so that electric power determined depending on a difference between the temperature of said fixing unit and the target temperature is supplied to said heater, wherein a period in which the electric power is supplied to said heater within a period of a half-cycle of the alternating current is divided into at least one first power supply period and a second power supply period which is a period corresponding to electric power obtained by subtracting electric power supplied in said at least one first power supply period from the electric power determined depending on the difference between the temperature of said fixing unit and the target temperature, wherein a length of a sum of all of said first power supply period is a length from 1/6000 to 1/40 of one cycle of the alternating current, and wherein a sum of electric power supplied in all of said first power supply period and electric power supplied in said second power supply period is determined depending on the difference between the temperature of said fixing unit and the target temperature.

9. An image forming apparatus according to claim 8, wherein said controller controls said switching element so that said first power supply period appears a plurality of times in the half-cycle of the alternating current, and wherein all said first power supply periods have the same length.

10. An image forming apparatus according to claim 8, wherein said controller controls said switching element so that said at least one first power supply period appears only once in the half-cycle of the alternating current, and wherein lengths of said at least one first power supply period are different from each other depending on the electric power determined depending on the difference between the temperature of said fixing unit and the target temperature.

11. An image forming apparatus according to claim 8, wherein said switching element is a field-effect transistor connected to said heater in series.

12. An image forming apparatus according to claim 8, wherein said switching element is a bidirectional thyristor.

13. An image forming apparatus according to claim 12, further comprising:

a first bidirectional thyristor connected to said heater in series;

a capacitor connected to said first bidirectional thyristor in series; and a second bidirectional thyristor connected in parallel to said first bidirectional thyristor and said capacitor which are connected to each other in series, wherein said controller carries out control by using said first bidirectional thyristor when the electric power is supplied to said heater in said at least one first power supply period, and carries out control by using said second bidirectional thyristor when the electric power is supplied to said heater in said second power supply period.

14. An image forming apparatus according to claim 8, further comprising a power source connected to said AC power source, wherein said control controls said switching element so that said second power supply period does not overlap with a period in which a current flows through said power source.

15. An image forming apparatus according to claim 1, wherein said fixing unit includes a cylindrical film and a roller contacting an outer surface of said cylindrical film, wherein said heater is located in an inner space of said film, and wherein a fixing nip portion through which the recording material passes is formed between said film and said roller by sandwiching said film between said film and said roller.

16. An image forming apparatus according to claim 8, wherein said fixing unit includes a cylindrical film and a roller contacting an outer surface of said cylindrical film, wherein said heater is located in an inner space of said film, and wherein a fixing nip portion through which the recording material passes is formed between said film and said roller by sandwiching said film between said film and said roller.

* * * * *